US005988551A

United States Patent [19]

Wiedemann

[11] Patent Number: 5,988,551

[45] Date of Patent: Nov. 23, 1999

[54] METHOD AND APPARATUS FOR SEVERING AND CONVEYING UNCOOLED AND NON-TOLERANCE ADHERING WIRE WINDINGS

[75] Inventor: Carsten Wiedemann, Meerbusch, Germany

[73] Assignee: SMS Schloemann-Siemag Aktiengesellschaft, Düsseldorf, Germany

[21] Appl. No.: 09/065,315

[22] Filed: Apr. 23, 1998

[30] Foreign Application Priority Data

Apr. 26, 1997 [DE] Germany ..... 197 17 770

[51] Int. Cl.[6] ..... B21C 47/24

[52] U.S. Cl. ..... 242/363; 242/361.3; 242/362.2

[58] Field of Search ..... 242/363, 361.3, 242/362.2, 362.3; 140/1, 2

[56] References Cited

U.S. PATENT DOCUMENTS

| | | | |
|---|---|---|---|
| 3,452,785 | 7/1969 | McLean et al. | 242/361.3 X |
| 5,263,657 | 11/1993 | Grotepass | 242/363 |

FOREIGN PATENT DOCUMENTS

| | | | |
|---|---|---|---|
| 3864421 | 9/1990 | European Pat. Off. | 242/363 |
| 3946672 | 10/1990 | European Pat. Off. | 242/363 |
| 3029229 | 4/1982 | Germany | 242/363 |
| 4109201 | 9/1992 | Germany | 242/363 |
| 4117906 | 12/1992 | Germany | 242/363 |

*Primary Examiner*—Donald P. Walsh
*Assistant Examiner*—William A. Rivera
*Attorney, Agent, or Firm*—Friedrich Kueffner

[57] ABSTRACT

A method and an apparatus for severing wire windings which are uncooled and not tolerance-adhering from the beginning and end of a rolling line conveyed over a Stelmor plant or comparable wire winding conveying systems, wherein initially a number of the front windings of the rolled strand are counted and in accordance with a predetermined number of windings these windings are severed as front crop from the finished wire. Subsequently, the severed windings are accelerated on a first conveyor and the following finished wire is decelerated, so that the cut location is widened during transport. The severed front cup windings are then deflected downwardly from the plane of the Stelmor plant or a comparable wire winding conveying system as they pass an initially open switch at the end of the first conveyor and the front crop windings are conveyed away, while finished wire is further conveyed in the Stelmor plant after closing the switch, and the severed windings which have been conveyed away are collected underneath the Stelmor plant and are shredded.

21 Claims, 7 Drawing Sheets

METHOD AND APPARATUS FOR SEVERING AND CONVEYING UNCOOLED AND NON-TOLERANCE ADHERING WIRE WINDINGS

BACKGROUND OF THE INVENTION

1. Field of the Invention

The present invention relates to a method and an apparatus for severing wire windings which are uncooled and not tolerance-adhering from the beginning and end of a rolling line conveyed over a Stelmor plant or comparable wire winding conveying systems.

2. Description of the Related Art

The range of dimensions of products of modern wire trains includes wire diameters of 5.0 to 25 mm with a range of final rolling speeds of between 120 and about 20 m/s. For adjusting the required structural properties, Stelmor speeds during cooling of between 0.1 m/s and about 1.2 m/s are necessary. In accordance with the final rolling speed which depends on the diameter, different placement densities of between 25 and 300 windings per meter result on the Stelmor conveyor or comparable wire winding conveying system.

In the case of thin wire dimensions and high final rolling speeds, the beginnings and ends of the rolled strand remain uncooled during rolling for reasons of preventing failures. The same is also true in the case of thick wire dimensions of, for example, 25 mm for ensuring that the windings are safely deposited. In addition, depending on the number of passes in the finishing block, for example, in the case of 2 to 10 passes, a certain length of the rolled strand is required at the beginning and end outside of the required dimensional tolerances. Consequently, the windings which are not cooled and are not tolerance-adhering, must be removed prior to compacting and binding the coil.

In accordance with the prior art, this is done at the coil beginning on the hook-type conveyor, specifically at the open hook side. Severing at the coil end is more difficult because this still requires a manual operation and each winding must be individually severed and removed. At temperatures of between 400° and 500° C., this results in extremely unfavorable and difficult work conditions for persons working at this location. On the one hand, this work is very labor intensive and, on the other hand, the work is very difficult because of the heat and heavy physical labor.

SUMMARY OF THE INVENTION

Therefore, starting from the prior art discussed above, it is the primary object of the present invention to provide a method and an apparatus of the above-described type in which the previously still required manual work during severing of uncooled and nontolerance-adhering wire windings from the beginning and end of a rolled strand being conveyed over a Stelmor plant or comparable wire winding conveying systems can be replaced by a reliable mechanized or automated system in order to achieve more human work conditions and more economical operation sequences.

In accordance with the present invention, initially a number of the front windings of the rolled strand are counted and in accordance with a predetermined number of windings these windings are severed as front crop from the finished wire. Subsequently, the severed windings are accelerated on a first conveyor and the following finished wire is decelerated, so that the cut location is widened during transport. The severed front cup windings are then deflected downwardly from the plane of the Stelmor plant or a comparable wire winding conveying system as they pass an initially open guide means or switch at the end of the first conveyor and the front crop windings are conveyed away, while finished wire is further conveyed in the Stelmor plant after closing the guide means or switch, and the severed windings which have been conveyed away are collected underneath the Stelmor plant and are shredded.

The rear crop windings are severed and conveyed away in a similar manner according to the present invention. The rearward end of the rolled strand is monitored and, after a predetermined residual length has been reached, the rearward end is severed from the rolled strand as rear crop, and the remaining finished wire severed from the rear crop is accelerated and the severed rear crop windings are simultaneously decelerated on the first conveyor, so that the cut location is widened, and finally the severed rear crop windings are deflected downwardly from the plane of the Stelmor plant or comparable wire winding conveying system when entering the open switch at the end of the first conveyor and the rear crop windings are conveyed away, are collected underneath the Stelmor plant or comparable wire winding conveying system and are comminuted or shredded.

The method according to the present invention provides the significant advantage that the step of severing uncooled and nontolerance-adhering wire windings is shifted from the coil at the hook of the hook-type conveyor into the conveying area of the Stelmor plant or comparable wire winding conveying system. This makes the previously necessary manual labor unnecessary and the efficiency of the method is simultaneously substantially improved.

In accordance with a preferred feature, the front crop windings or the rear crop windings are coiled after passing the switch underneath the Stelmor plant or comparable wire winding conveying system into minicoils, for example, on a collecting mandrel, and these minicoils are conveyed away and collected for further processing.

In accordance with a further development of the method, the first conveyor constructed as a switch can be pivoted downwardly into an inclined position for opening the conveying path from the plane of the Stelmor plant or comparable wire winding conveying system and can be pivoted upwardly for closing the conveying path, or the subsequent segment of the conveying path is pivoted upwardly into an upwardly inclined position from the conveying plane and is pivoted downwardly for closing the conveying plane.

In accordance with an alternative embodiment, the switch may be configured as stub rollers which are displaceable transversely of the conveying direction, wherein the stub rollers are moved apart from each other for opening the conveying path and are moved together again for closing the conveying path.

In accordance with a further development of the invention, the switch is opened as the severing cut is carried out for discharging the front crop windings and is closed immediately prior to the moment the cut point or location reaches the end of the first conveyor, wherein, after severing and discharging the front crop, the finished wire is conveyed over the Stelmor plant or comparable wire winding conveying system.

Finally, the method according to the present invention provides that severing of the rear crop windings is carried out at that moment at which the optically or magnetically monitored rearward end of the rolled strand has reached a predetermined position, for example, in the area of the wire finishing block.

In an apparatus for severing and conveying away uncooled and nontolerance-adhering wire windings from the beginning and end of a rolled strand conveyed over a Stelmor plant or a comparable wire winding conveying system, including a wire finishing block with subsequently arranged driver, a coiler and a shear, as well as a subsequently arranged cooling stretch in the form of the Stelmor plant or comparable wire winding conveying system, particularly for carrying out the above-described method, the wire finishing block includes a device for monitoring the position of the rearward end of the rolled strand, wherein within the Stelmor or comparable wire winding conveying system is provided a first conveyor including a roller conveyor segment and switch at the end thereof, and wherein the first conveyor includes a device for the controlled monitoring of the number of wire windings and the location of the traveling cut point, wherein the device for the controlled monitoring includes means for controlling the shear as well as for opening and closing the switch.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
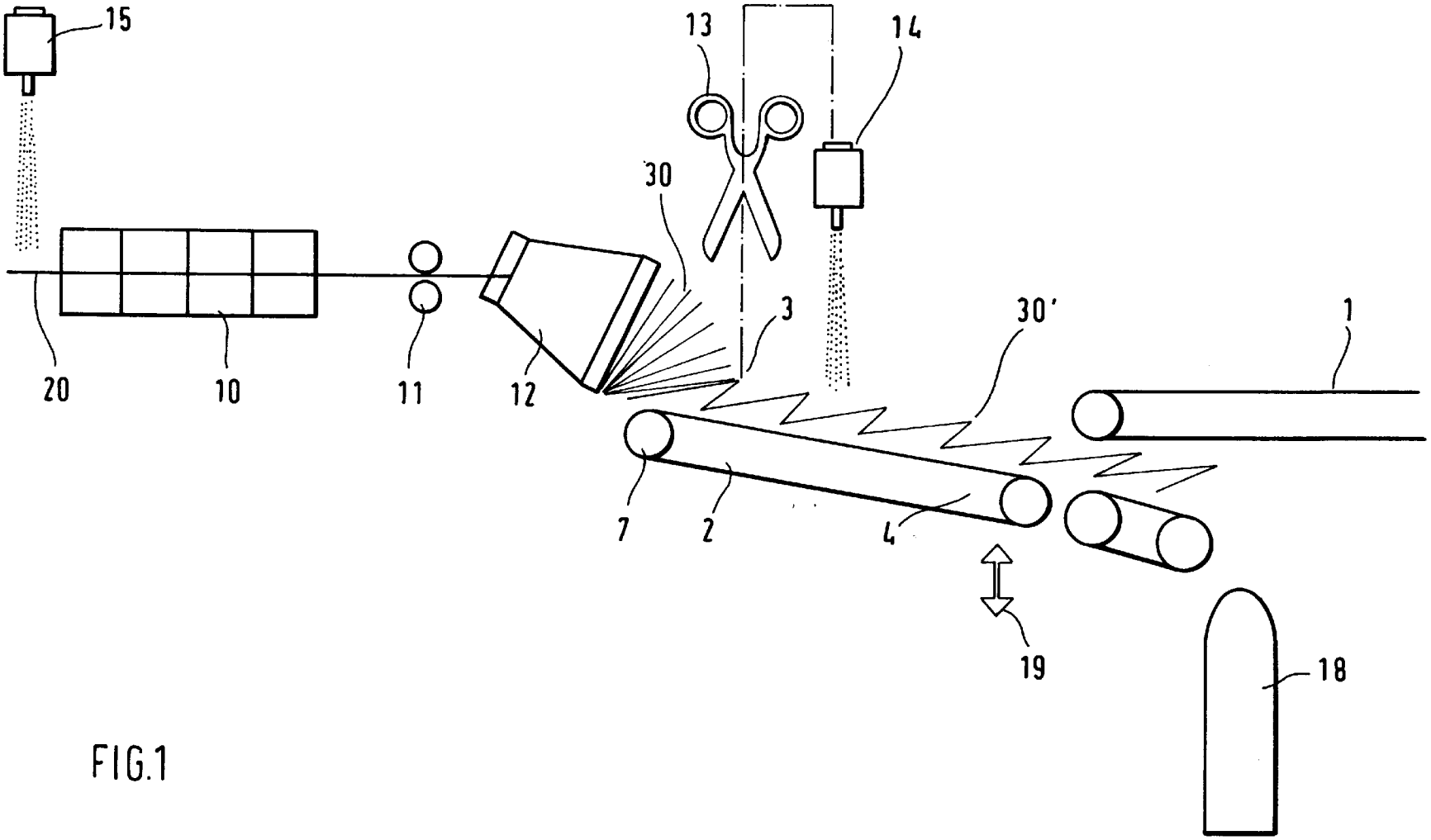
FIGS. 1–3 are schematic overviews of a plant for severing and conveying away front crop windings of a rolled strand.

In the plant illustrated in FIG. 1, a rolled strand 20 travels through the wire finishing block 10 while being continuously controlled by an electronic sensing device and reaches through the driver 11 the coiler 12 which places wire windings on a limited first conveyor 2 of the Stelmor plant 1 or a comparable wire winding conveying system. For example, the first conveyor 2 is mounted so as to be pivotable about a horizontal axis at the rearward end 7 and is constructed at the front end 4 as a moveable switch, supported by a lifting device 19.

Figure 3:
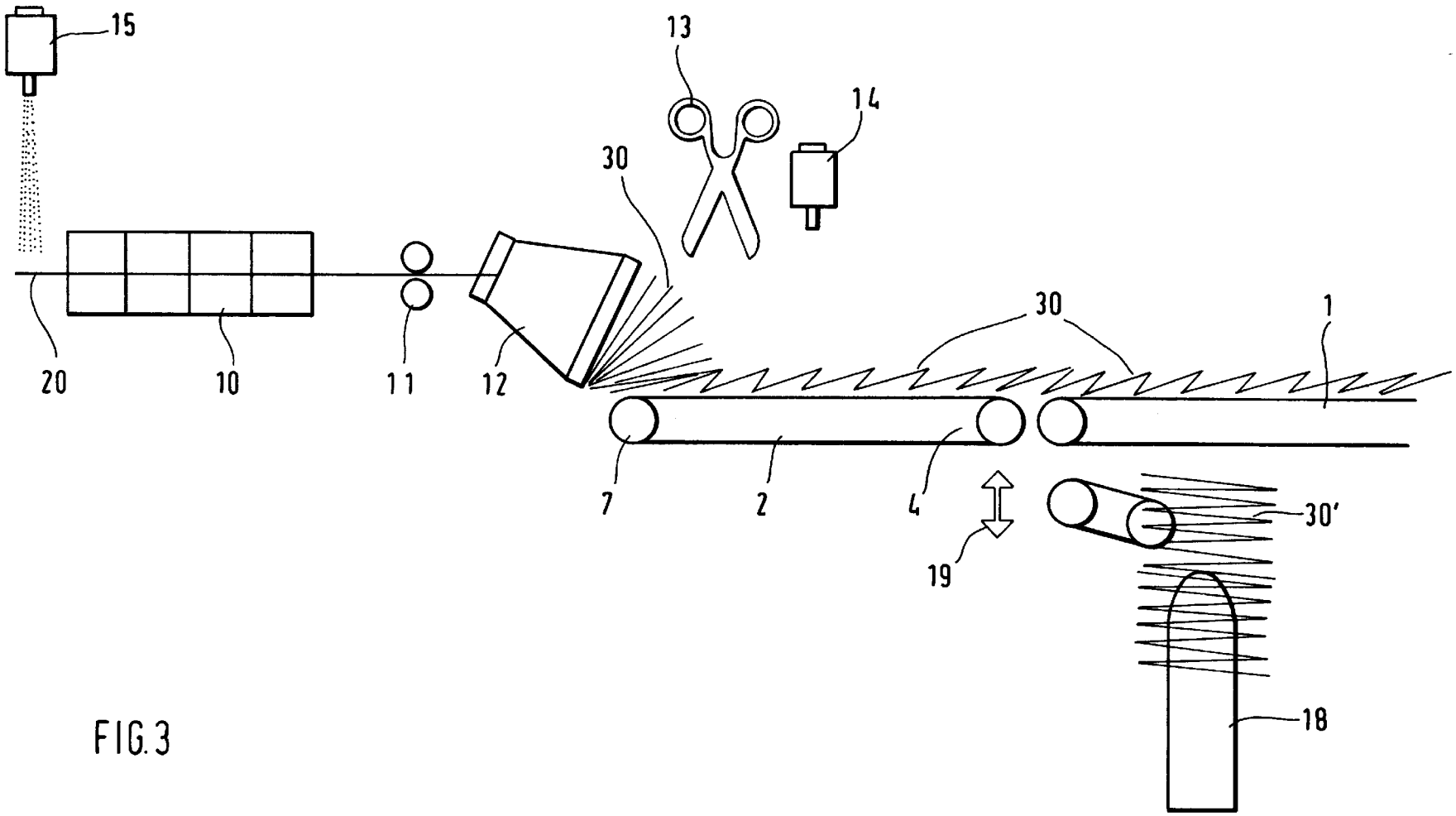

The coiler 12 is followed by a shear 13 which when actuated severs the rolled strand 20 at a cut point 3 into a front crop 30' and finished wire 30. The shear 13 may also be arranged in front of the coiler 12. The Stelmor plant 1 or a comparable wire winding conveying system following the switch 4 conveys the finished wire 30 severed from the front crop 30' in the known manner over a longer cooling stretch of the Stelmor plant 1, as shown in FIG. 3. An optical or magnetic counting unit 14 is located above the first conveyor 2. The counting unit 14 counts a predetermined number of front crop windings 30' and, in accordance with a predetermined number of these windings 30', transmits an operating command to the shear 13 which then carries out at the cut point 3 the separation of the front crop 30' and the finished wire 30.

Figure 2:
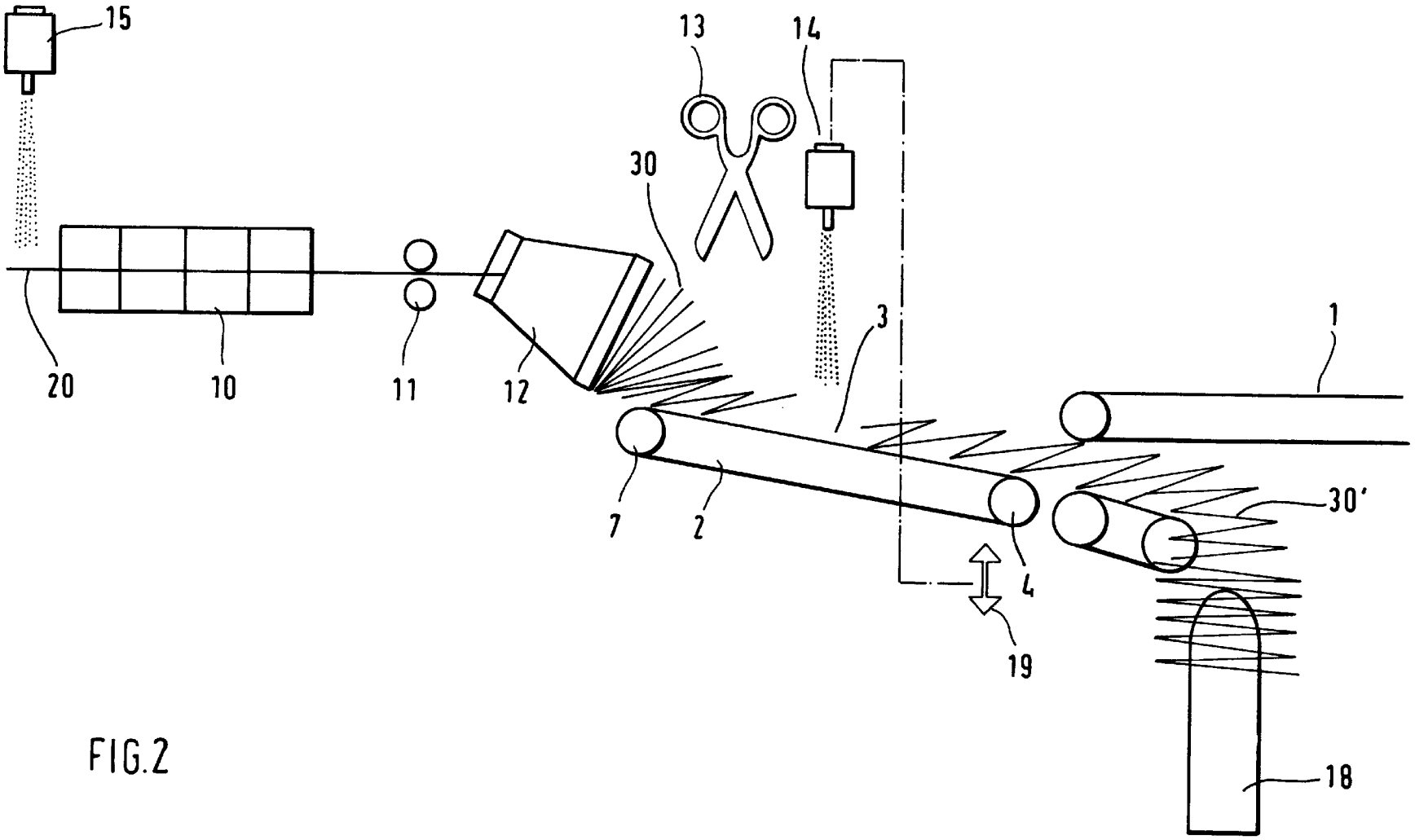

As FIG. 2 shows in this connection, the counting unit 14 also controls the cut point 3 and, after, for example, a predetermined period of time has expired, transmits a closing command to the lifting device 19. A predetermined time delay is computed or selected in such a way that the switch 4 is closed immediately after the last front crop winding 30' has left and before the first winding of the finished wire 30 arrives. In order to provide sufficient time for this purpose, the severed front crop windings 30' are accelerated on the limited first conveyor 2 and the severed finished wire 30 is decelerated, so that the cut point 3 is widened during transport. As illustrated in FIG. 2, the severed front crop windings 30' are deflected downwardly and conveyed away from the plane of the Stelmor plant 1 or comparable wire winding conveying system when passing the open switch 4 at the end of the conveyor 2, while, as shown in FIG. 3, after closing the switch 4 by means of the lifting unit 19, the finished wire 30 is further conveyed in the Stelmor plant or comparable wire winding conveying system.

The front crop windings 30' which have been downwardly conveyed in accordance with FIG. 2 over the initially open switch 4 can be collected, for example, by means of a mandrel 18 to form minicoils, or they can be conveyed by means of a driver to a shredding shear and shredded in the shredding shear. This portion of the plant is known in the art and is not illustrated for this reason.

Figure 4:
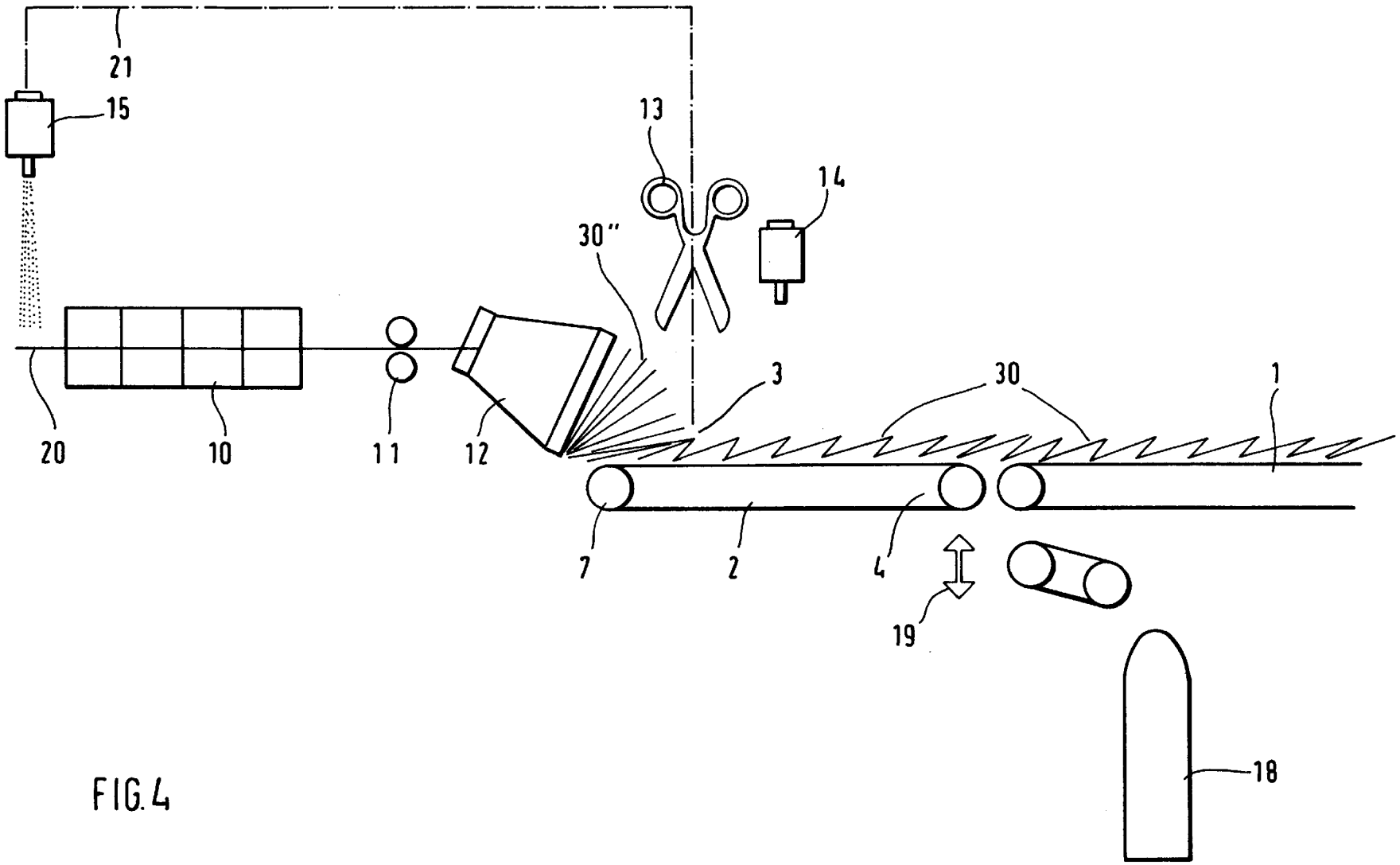
FIGS. 4–6 are schematic overviews of a plant for severing and conveying away rear crop windings of a roll strand.

As can be seen in FIGS. 1 through 5, the control unit 15 monitors by means of electronic or magnetic sensing means the rolled strand 20 and triggers a signal as soon as the beginning or end have reached a predetermined position in front of or within the wire finishing block 10. This signal is transmitted through the signal line 21, shown in FIG. 4, to the shear 13 which then, in accordance with a predetermined length of the end of the rolled strand 20, severs this end from the remaining finished wire 30 at a severing location 3, as illustrated in FIG. 4. The control unit 14 then takes over control of the traveling cut point 3 and, after a predetermined delay period, causes the lifting device 19 to lower the first conveyor 2, i.e., to open the switch 4. The previous piece of finished wire 30 of the rolled strand travels over the cooling stretch of the Stelmor plant 1, while the rear crop windings 30" are deflected downwardly when entering the switch 4 and, in the manner already described above, are collected on the mandrel 18 into minicoils or are shredded, for example, into scrap.

FIG. 4 of the drawing shows the apparatus at the moment of a state of operation at which the control unit 15 has sensed the end of the rolled strand 20 and triggers a signal through the signal line 21 for activating the shear 13. The shear 13 then immediately cuts the rolled strand or the finished wire 30 at the cut point 3 into finished wire 30 and a remaining piece of predetermined length to be placed in rear crop windings 30".

Figure 5:
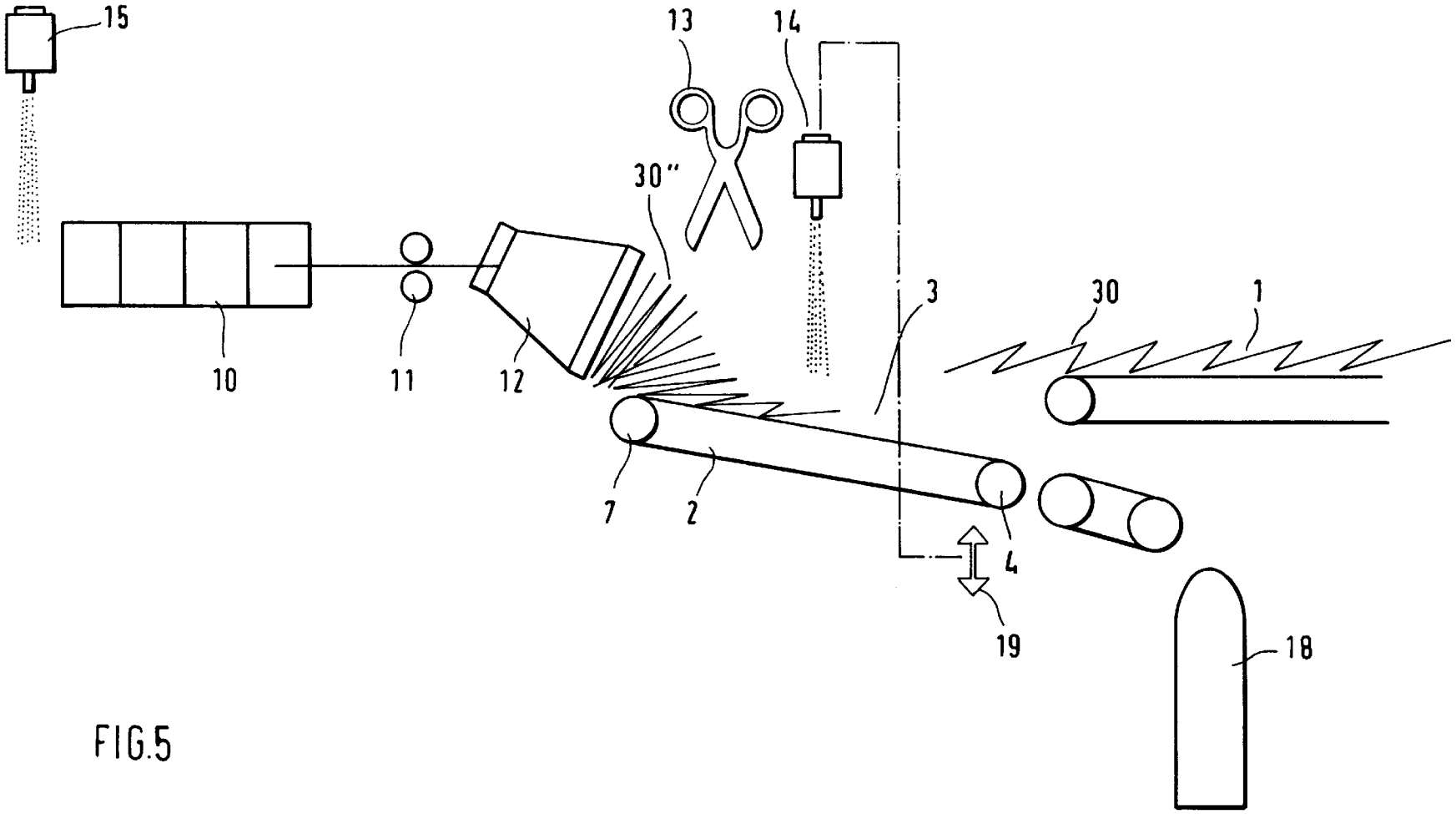
Figure 6:
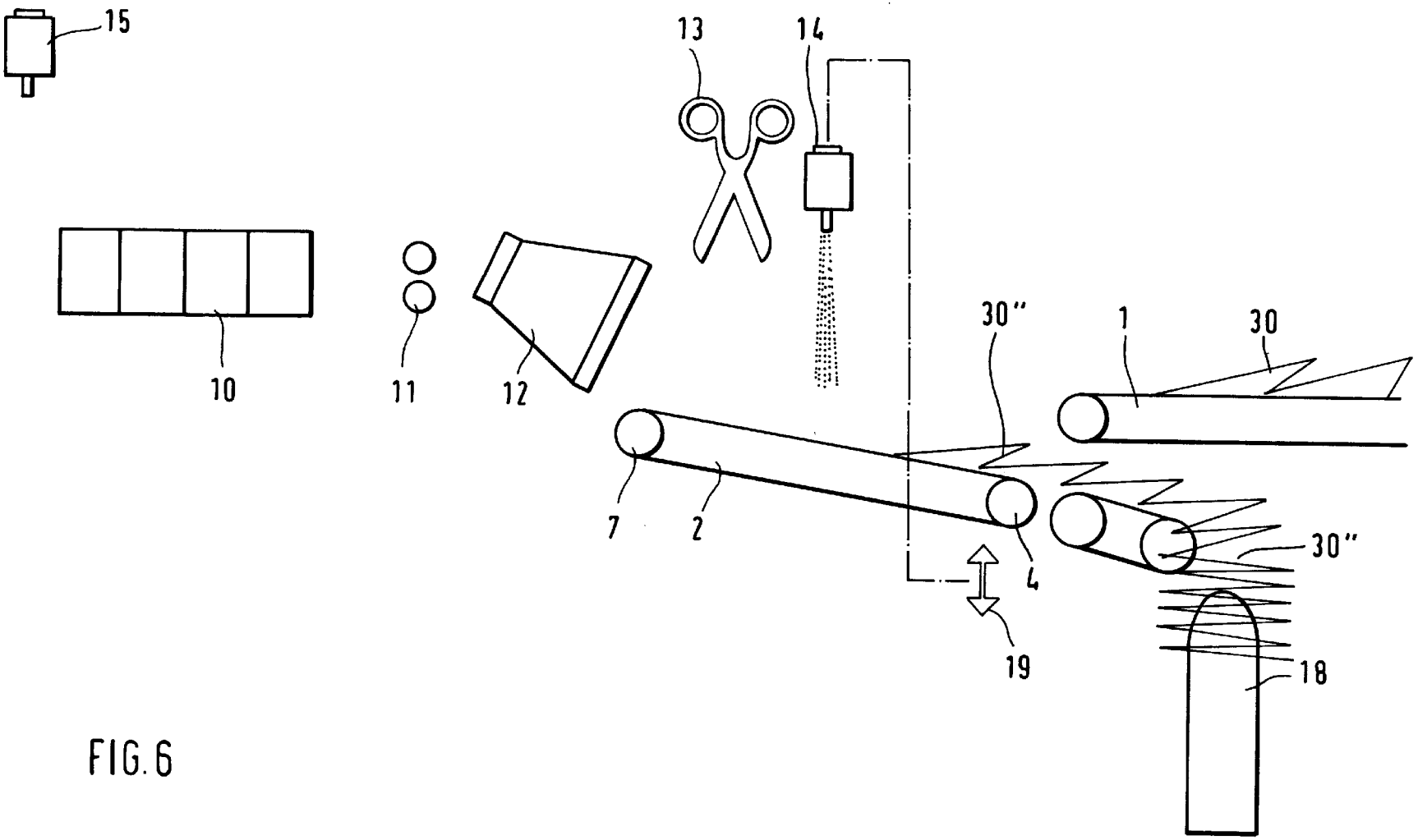

FIG. 5 of the drawing shows the apparatus at the moment of a state of operation at which the counting unit 14 senses the cut point 3 shortly before the end of the conveyor 2 and with a predetermined delay causes opening of the switch 4 by downwardly pivoting the conveyor 2 by means of the lifting device 19. As a result, as shown in FIG. 6, the rear crop windings 30" are deflected below the level of the Stelmor plant 1 or comparable wire winding conveying system, while the finished wire 30, after having now been severed from the front crop windings 30' and rear crop windings 30'", is conveyed further over the Stelmor plant 1 or comparable wire winding conveying system. As was the case with the front crop windings 30' as shown in FIG. 2, the rear crop windings 30" are deflected downwardly and as desired collected into minicoils on the collecting mandrel 18 or comminuted into scrap particles in a shredding shear.

Figure 7:
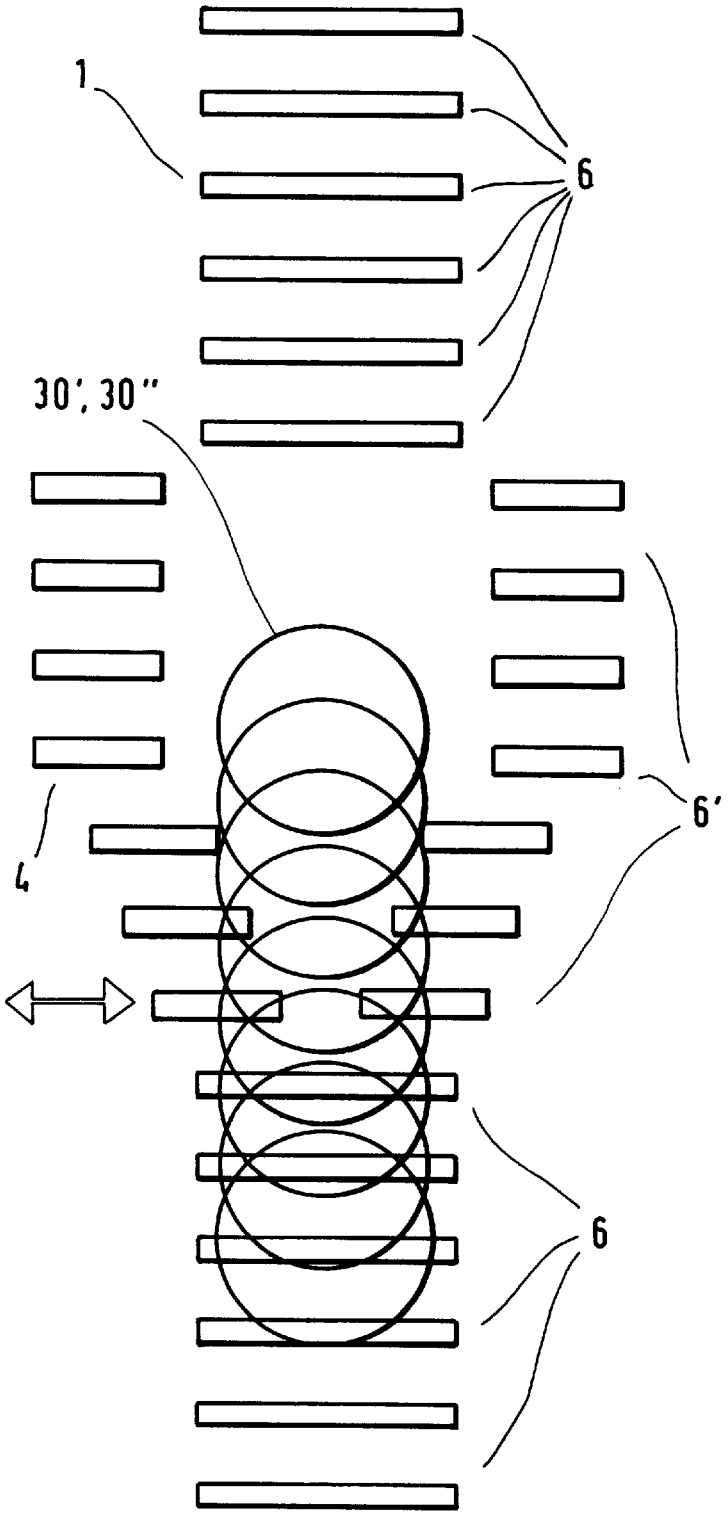
FIG. 7 is a schematic top view of an arrangement of laterally displaceable stub rollers which are constructed as a switch.

FIG. 7 of the drawing shows the configuration of a switch 4 at the entry area of the Stelmor plant 1 or comparable wire winding conveying system in the form of laterally displaceable stub rollers 6. In the illustrated open position of the stub rollers 6', the wire windings 30' of FIGS. 1 and 2, or the wire windings 30" of FIGS. 5 and 6 drop downwardly through the switch 4.

The features and further developments of the present invention are not limited to the embodiments illustrated in the drawing. In accordance with possible modifications, for example, the severing device 13, the construction of the switch 4 or the collecting device with the mandrel 18 or the monitoring units 14, 15 may be of a different type. The acceleration of severed windings or the deceleration of subsequent windings can be effected by means of variable roller conveyor speeds or by means of separate devices, such as, grippers, chains, transport fingers. Those skilled in the art are free to choose structural configurations to adapt to the special configurations or uses or problems.

While specific embodiments of the invention have been shown and described in detail to illustrate the inventive principles, it will be understood that the invention may be embodied otherwise without departing from such principles.

I claim:

1. A method of severing and conveying uncooled and nontolerance-adhering wire windings from a beginning and an end of a rolled strand which is conveyed over a wire winding conveying system, the method comprising counting a number of front windings of the rolled strand and severing the front windings as front crop windings from finished wire in accordance with a predetermined number of windings, accelerating the severed front crop windings on a limited first conveyor and decelerating the finished wire, so that a cut point between the front crop windings and the finished wire is widened, downwardly deflecting and conveying away the severed front crop windings when passing an open guide means at an end of the first conveyor from the plane of the wire winding conveying system, further conveying the finished wire after closing the guide means in the wire winding conveying system.

2. The method according to claim 1, further comprising collecting the severed and conveyed front crop windings underneath the wire winding conveying system and shredding the front crop windings.

3. The method according to claim 1, wherein the wire winding conveying system is a Stelmor plant.

4. The method according to claim 1, further comprising monitoring a rearward end of the rolled strand and severing the rolled strand as rear crop windings when a predetermined residual length has been reached, accelerating the finished wire severed from the rear crop windings and decelerating the rear crop windings on the first conveyor in order to increase a cut point between the finished wire and the rear crop windings, downwardly deflecting the severed rear crop windings when traveling into the open guide means at the end of the first conveyor from the plane of the wire winding conveying system and conveying away the rear crop windings.

5. The method according to claim 4, further comprising collecting the rear crop windings underneath the wire winding conveying system and comminuting the rear crop windings.

6. The method according to claim 4, further comprising coiling the rear crop windings after passing the guide means underneath the wire winding conveying system into minicoils and conveying away the minicoils and collecting the minicoils for further processing.

7. The method according to claim 6, comprising forming the minicoils on a mandrel.

8. The method according to claim 4, comprising severing the rear crop windings at a moment at which an optically or magnetically monitored rearward end of the rolled strand has reached a predeterminable position.

9. The method according to claim 8, wherein the predetermined position is within an area of a wire finishing block.

10. The method according to claim 1, further comprising coiling the front crop windings after passing the guide means underneath the wire winding conveying system into minicoils and conveying away the minicoils and collecting the minicoils for further processing.

11. The method according to claim 10, comprising forming the minicoils on a mandrel.

12. The method according to claim 1, comprising pivoting downwardly into an inclined position from a conveying plane the first conveyor for opening the guide means and pivoting upwardly the first conveyor into the conveying plane for closing the guide means.

13. The method according to claim 1, comprising upwardly pivoting into an inclined position a segment following the first conveyor from a conveying plane for opening the guide means and pivoting downwardly the segment into the conveying plane for closing the guide means.

14. The method according to claim 1, comprising moving apart stub rollers mounted on both sides of the rolled strand and displaceable transversely of the rolled strand for opening the guide means and moving together the stub rollers for closing the guide means.

15. The method according to claim 1, further comprising opening the guide means for conveying away the front crop windings simultaneously with severing the rolled strand and closing the guide means immediately prior to arrival of the cut point at the end of the first conveyor.

16. An apparatus for severing and conveying away at least one of uncooled and nontolerance-adhering front crop windings and rear crop windings at a beginning and an end of a finished wire of a rolled strand being conveyed by a wire winding conveying system, the apparatus comprising a wire finishing block with a subsequent driver, a coiler and a shear and a subsequent cooling stretch formed by the wire winding conveying system, the wire finishing block comprising a unit for monitoring a position of a rearward end of the rolled strand, a first conveyor comprising a roller conveyor segment acting as a guide means mounted within the wire winding conveying system, wherein the guide means is movable between an open position for deflecting and conveying away crop windings and a closed position for conveying finished wire in the wire winding conveying system, the first conveyor comprising a unit for effecting controlled monitoring of a predetermined number of wire windings and a cut point of the rolled strand which travels along the wire winding conveying system, wherein the monitoring unit comprises means for controlling the shear and for opening and closing the guide means.

17. The apparatus according to claim 16, wherein the wire winding conveying system is a Stelmor plant.

18. The apparatus according to claim 16, wherein the roller conveyor segment acting as the guide means is configured to be downwardly pivotable into an inclined position about a horizontal axis at a rearward end of the first conveyor, further comprising a lifting device for upwardly pivoting the roller conveyor segment at a front end of the first conveyor.

19. The apparatus according to claim 16, wherein the roller conveyor segment comprises a plurality of transversely displaceable stub rollers which are configured to be moveable apart from each other for opening the guide means and toward each other for closing the guide means.

20. The apparatus according to claim 16, wherein the first conveyor comprises means for one of accelerating and decelerating a conveying speed of the rolled strand.

21. The apparatus according to claim 20, wherein the means are controllable motors.

* * * * *